US011484742B1

(12) United States Patent
Bachman

(10) Patent No.: US 11,484,742 B1
(45) Date of Patent: Nov. 1, 2022

(54) JUMP TRAINING APPARATUS AND METHOD

(71) Applicant: Blaine Lytle Bachman, Dimondale, MI (US)

(72) Inventor: Blaine Lytle Bachman, Dimondale, MI (US)

( * ) Notice: Subject to any disclaimer, the term of this patent is extended or adjusted under 35 U.S.C. 154(b) by 0 days.

(21) Appl. No.: 17/472,751

(22) Filed: Sep. 13, 2021

(51) Int. Cl.
*A63B 5/16* (2006.01)

(52) U.S. Cl.
CPC ..... *A63B 5/16* (2013.01); *A63B 2214/00* (2020.08)

(58) Field of Classification Search
CPC ..... A63B 5/16–22; A63B 2214/00
See application file for complete search history.

(56) References Cited

U.S. PATENT DOCUMENTS 2,469,145 A * 5/1949 Baliff ..... A63B 5/16 482/148
4,208,050 A * 6/1980 Perrine ..... A63B 5/16 482/148
5,031,903 A * 7/1991 Clarke ..... A63B 5/16 482/148
7,097,589 B2 * 8/2006 Underwood ..... A63B 5/16 482/15
7,530,925 B2 * 5/2009 Underwood ..... A63B 5/16 482/148
9,109,871 B2 * 8/2015 Cozens ..... G01B 5/061
9,472,130 B2 * 10/2016 Sharpe ..... G09F 7/08
2005/0202935 A1 * 9/2005 Underwood ..... A63B 5/16 482/15
2009/0023557 A1 * 1/2009 Underwood ..... A63B 5/16 482/15

* cited by examiner

*Primary Examiner* — Andrew S Lo
(74) *Attorney, Agent, or Firm* — Thomas P. Heed; Heed Law Group PLLC

(57) ABSTRACT

A jump training apparatus and method designed to allow athletes to perform sets of standing vertical jumps. The apparatus is comprised of a mount, a T-tube, a notched post, and a plurality of vertically hanging rotational vanes of varying lengths. Each rotational vane has a longitudinal member with a planar surface. Each rotational vane has a cylindrical opening with a stop member. The plurality of rotational vanes are placed over the notched post by aligning the stop member with a channel cut in the notched post. When the stop member contacts the edges of the channel, it causes the rotational member to stop rotating. A central bump in the channel further inhibits motion.

24 Claims, 7 Drawing Sheets

JUMP TRAINING APPARATUS AND METHOD

FIELD OF INVENTION This invention relates to the classifications for physical training and training equipment. Specifically, this invention is a jump training apparatus.

BACKGROUND OF INVENTION

We live in a metric-driven society. Nowhere is this more apparent than in the field of athletics, where an individual is reduced to a series of numbers intended to define their physical talent. The speed, strength, stamina, and explosiveness of an athlete is repeatedly measured and recorded.

In football, basketball, and other sports, a standing vertical jump is one of the metrics for which an athlete is measured. For example, in basketball, athletes at the secondary, collegiate, and professional levels are all assessed on vertical jump. A great standing vertical jump measurement often differentiates those who will become professional athletes from those who will not.

To date, the prior art has been concerned with measuring an athlete's standing vertical jump. Little of the prior art has attempted to improve an athlete's standing vertical jump using well-known and proven methods of exercise and training.

The de facto standard for measuring the height of a standing vertical jump has a plurality of vanes of equal length attached horizontally to a post. The vanes are free to rotate about the post. The athlete jumps and swats the vanes, causing the vanes that were swatted to spin. The height of the athlete's standing vertical jump is based on the highest vane that was rotated. This is the apparatus taught by US4208050A by named inventor Perrine ("Perrine '050"). The Perrine '050 apparatus had drawbacks, the most notable of which was that it could tip over.

Subsequently, the prior art improved on Perrine '050. For example, US7097589B2, by the named inventor Underwood ("Underwood '589"), teaches a safety jump training apparatus, intended to be mounted to a wall so that an athlete's standing vertical jump can be measured. Underwood '589 is essentially Perrine '050, but wall-mounted. Underwood '589 teaches a plurality of rotatable vanes mounted on a post, wherein the rotatable vanes are all an equal length. The vanes are arranged horizontally. The apparatus is mounted to a wall. The athlete jumps and swats at the vanes. The vanes the athlete was able to swat rotate, indicating how high the athlete was able to jump. In order for the athlete to jump again, all of the vanes need to be reset, a somewhat time-consuming endeavor.

Further improvements were made to the art in US 7530925B2 by named inventor Underwood ("Underwood '925"), which disclosed a portable version of the Underwood '589, but a portable version that would not tip.

The problem with the de facto standard is that it does not allow the athlete to make repeated jumps. In other words, to perform sets of measured jumps, much like sets in weight lifting. Sports science knows that repeated muscle training and exertion is the formula for improved performance. What the market needs is a variation of the de facto jump trainer that quickly and automatically resets, allowing an athlete to make repetitive measured jumps.

SUMMARY OF THE INVENTION

This summary is intended to disclose the present invention, a novel jump training apparatus and method. Embodiments of the invention are presented to illustrate and inform one skilled in the art.

The jump training apparatus is comprised of a notched post, a mounting means for securely holding the notched post parallel horizontal; and a plurality of rotational vanes. In the preferred embodiment, the mounting means is comprised of a mount suitable for affixing the jump training apparatus to a structure; and a T-tube having a first opening, a second opening, and a third opening. The mount enables the present invention to be wall-mounted or ceiling mounted. The T-tube enables the present invention to be presented to the user in the proper orientation, regardless of whether it is mounted to the wall or ceiling.

For the sake of illustration, consider the mount attached to the wall. The T-tube is attached to the mount and secured with a set screw. The notched post is placed in an opening of the T-tube such that the notched post is horizontal. The notched post is secured to the T-tube with a set screw. The notched post has an outer surface which is a cylindrical segment with a channel. The notched post is a cylinder with the exception of the channel. The channel runs length-wise for the entire length of the notched post. Two edges cut the cylindrical segment creating a channel. The channel has two ends. A first end has the cross section of a circle interrupted by a cross-section of the channel. The second end is the wall-end. The channel terminates at a wall-end. The wall-end has a cross-section that is circular. In other words, the wall-end of the notched post is a cylinder, which is integral with the cylindrical segment containing the channel.

In the center of the channel is a bump. The channel has two sloping sides, one originating at each of the two edges. The two sloping sides terminate at the bump in the center of the channel.

Each of the plurality of rotational vanes has a longitudinal member having a tip, a planar surface, and a length. The longitudinal member terminates at, and is integral with, a cylindrical element having a rim, a cylindrical outer surface, a cylindrical inner surface, and a stop member. The stop member is attached to and projects away from the cylindrical inner surface of the cylindrical element. In the illustrated example, the stop member is parallel with the longitudinal member, but it need not be. The length of the longitudinal member is measured from the tip of the longitudinal member to the spot at which the longitudinal member meets the outer cylindrical surface. The tip of the longitudinal member is the tip of the rotational vane.

The rotational vanes are placed over the notched post so that the rotational vanes hang vertically. The stop member of the rotational vane fits within the channel. Starting at the mount end of the notched post, the rotational vanes are arranged in descending length from the longest rotational vane to the shortest rotational vane. The phrase longest rotational vane means the rotational vane having the longitudinal member with the longest length. Likewise, the phrase shortest rotational vane means the rotational vane having the longitudinal member with the shortest length. In use, this means that rotating the longest rotational vane equates to the shortest standing vertical jump that is measurable by this invention. Likewise, rotating the shortest rotational vane equates to the highest standing vertical jump that is measurable by this invention. In order to accommodate shorter standing vertical jumps, the mount can be lowered so that it is closer to the ground. In order to accommodate higher standing vertical jumps, the mount can be raised so that it is further away from the ground. Of course, the ordering of the rotational vanes on the notched post can be reversed, starting with the shortest rotational vane nearest to the wall and ascending in length to the longest rotational vane being furthest from the wall.

There are twelve rotational vanes in the plurality of rotational vanes in the illustrations contained in this application. Those skilled in the art will appreciate that the number of rotational vanes in the plurality of rotational vanes can easily be increased or decreased from there. The present invention can easily use a plurality of rotational vanes containing 48 rotational vanes. Likewise, the present invention can be practiced by using as few as 4 rotational vanes. The length increment between adjoining rotational vanes can likewise be tailored to the needs of the user. The illustrations used herein show vanes that differ in length by 1", with respect to their adjoining vanes. The length increment can easily be increased to 2" or even 3". Likewise, the length increment can be decreased to ½ in order to get more sensitivity to the standing vertical jump measurement. The length increment can also be 1 cm in a metric version of the present invention. The usable range of the present invention is dependent on both the number of rotational vanes and the length increment between the rotational vanes.

The mount has two screw holes to affix the mount to a wall, ceiling, or other suitable structure. The mount is comprised of a protrusion, and a planar surface. The planar surface has rounded edge. The protrusion is sized to fit within the T-tube 12. When the protrusion is inserted into the T-tube, it is secured with a set screw.

The T-tube has three openings. Two openings are parallel with one another, facing opposite directions. The third opening is perpendicular to the other two openings. Each opening has a hole capable of accepting a set screw. The openings are sized such that the notched pole can fit into any of the three openings. Likewise, the three openings are sized to receive a protrusion projecting from the mount. In this way, the T-tube allows the jump trainer apparatus to be properly oriented with the notched post in a horizontal position, regardless of whether the mount is affixed to a wall or a ceiling.

In use, the plurality of vanes fit over the notched pole. Each of the plurality of vanes has a stop member. A rotational vane can only swing until the stop member hits one of the two sloping sides of the channel. The stop member will have an elastic collision with one of the two sloping sides of the channel, causing the rotational vane to reverse direction. The center bump in the channel will interfere with the stop member as it swings past, quickly bringing the rotational vane to rest.

The present invention is designed so that the rotational vanes settle quickly enough so that a user can repeatedly and predictably jump and hit them, knowing which rotational vane was hit or swatted on each jump. This invention allows a user to perform standing vertical jump sets. For example, a set of standing vertical jumps may comprise ten jumps in rapid succession. The concept is designed to tire the jumping muscles, much like lifting weights tires the lifting muscles. The user can perform multiple sets of such jumps, selecting the same intermediate value for each set. Alternately, the user could perform multiple sets of standing vertical jumps, selecting a different intermediate value for each set. Moreover, the number of discrete jumps in each set may be different. For example, a first set may be performed with 10 jumps. A second set may be performed with 8 jumps. A third set may be performed with 6 jumps. Alternatively, the user may be tasked with repeatedly jumping and striking a pre-defined rotational vane until the user is no longer capable of attaining the needed hit to strike the pre-defined rotational vane.

BRIEF DESCRIPTION OF THE DRAWINGS

The present invention is illustrated with 7 drawings on 7 sheets. The accompanying drawings, which are incorporated in and constitute a part of this disclosure, illustrate various example embodiments. In the drawings.

DETAILED DESCRIPTION OF THE DRAWINGS

Figure 1:
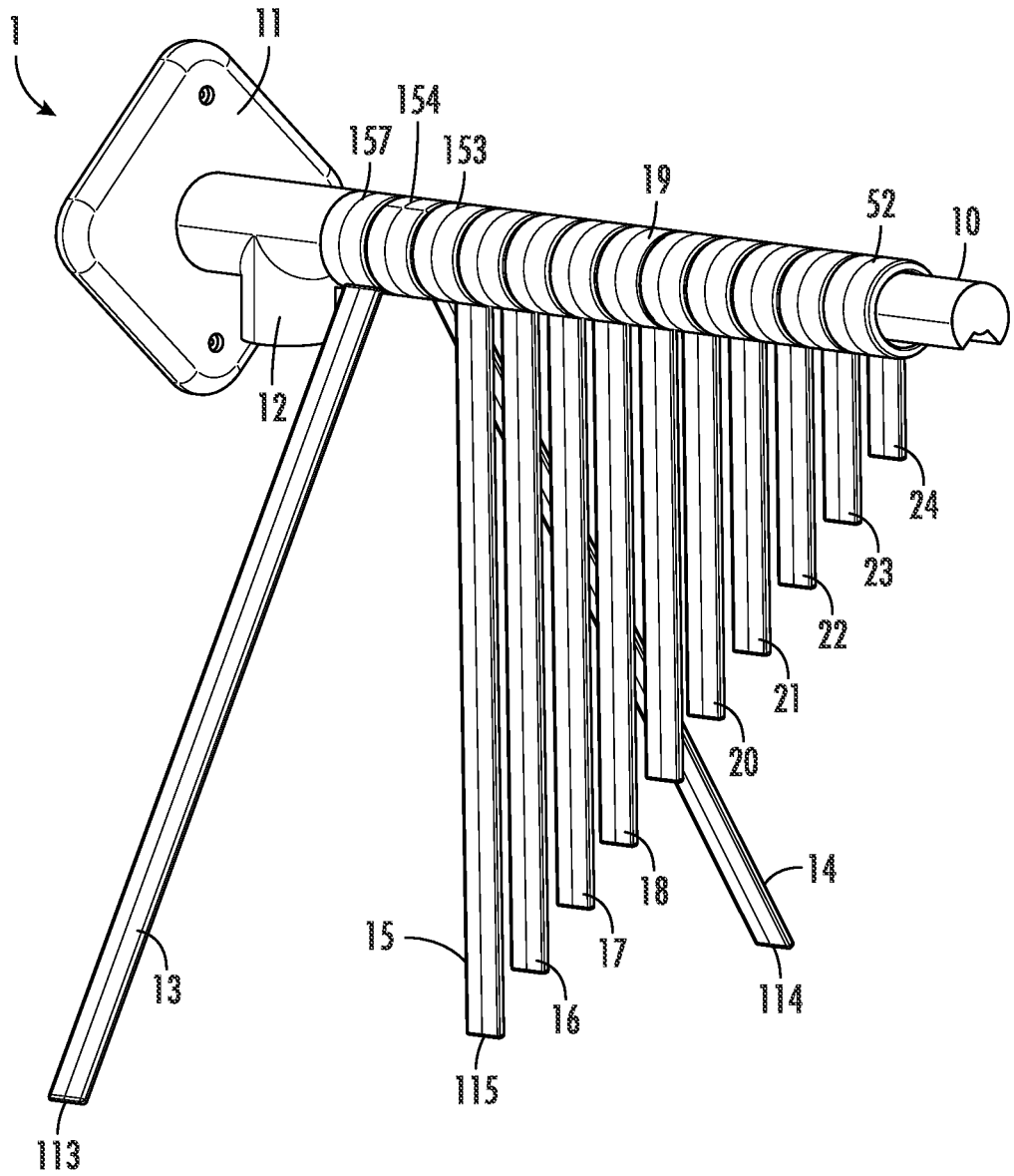
FIG. 1 is a perspective view of the invention.

The following descriptions are not meant to limit the invention, but rather to add to the summary of invention, and illustrate the present invention, a jump training apparatus and method. The present invention is illustrated with a variety of drawings showing the primary embodiments of the present invention, with various diagrams and figures explaining its workings.

Certain terminology is used in the following description for convenience only and is not limiting. The article "a" is intended to include one or more items, and where only one item is intended the term "one" or similar language is used. To assist in the description of the present invention, words such as short, long, top, bottom, side, upper, lower, front, rear, inner, outer, right and left are used to describe the relative size and orientation of the jump training apparatus, with respect to the accompanying figures. The terminology includes the words above specifically mentioned, derivatives thereof, and words of similar import.

The following detailed description refers to the accompanying drawings. Wherever possible, the same reference numbers are used in the drawings and the following description to refer to the same or similar elements. The embodiments of the claimed subject matter may be described, modified, and adapted, and other implementations are possible. For example, substitutions, additions, or modifications, which perform identical functions to the embodiments disclosed, may be made to the elements illustrated in the drawings. Accordingly, the following detailed description does not limit the claimed subject matter. The proper scope of the claimed subject matter is defined by the claims contained herein. The claimed subject matter improves over the prior art by providing a jump training apparatus that allows an athlete to perform a series of measured standing vertical jumps.

FIG. 1 shows the jump trainer apparatus 1. The jump trainer apparatus 1 is comprised of a mount 11, a T-tube 12, a notched post 10, and a plurality of rotational vanes 13, 14, 15, 16, 17, 18, 19, 20, 21, 22, 23, 24. The present invention 1 can be wall-mounted or ceiling mounted. FIG. 1 shows a wall-mounted configuration. The mount 11 is attached to a wall. The T-tube 12 is attached to the wall mount 11. The notched post 10 is placed in an opening of the T-tube 12 such that the notched post 10 is horizontal; in other words, the notched post 10 is parallel to the ground. The rotational vanes 13, 14, 15, 16, 17, 18, 19, 20, 21, 22, 23, 24 are placed over the notched post 10 so that the rotational vanes 13, 14, 15, 16, 17, 18, 19, 20, 21, 22, 23, 24 are arranged vertically.

Starting at the mount 11 end of the notched post 10, the rotational vanes 13, 14, 15, 16, 17, 18, 19, 20, 21, 22, 23, 24 are arranged in descending length from the longest rotational vane 13 to the shortest rotational vane 24. In use, this means that rotating the longest rotational vane 13 equates to the shortest standing vertical jump that is measurable by this invention 1. Likewise, rotating the shortest rotational vane 24 equates to the highest standing vertical jump that is measurable by this invention. In order to accommodate shorter standing vertical jumps, the mount 11 can be lowered so that it is closer to the ground. In order to accommodate higher standing vertical jumps, the mount 11 can be raised so that it is further away from the ground.

The usable range of the present invention 1 is dependent on both the number of rotational vanes 13, 14, 15, 16, 17, 18, 19, 20, 21, 22, 23, 24 and the length increment between the rotational vanes 13, 14, 15, 16, 17, 18, 19, 20, 21, 22, 23, 24. For example, FIG. 1 shows 12 rotational vanes 13, 14, 15, 16, 17, 18, 19, 20, 21, 22, 23, 24 in the plurality of the rotational vanes 13, 14, 15, 16, 17, 18, 19, 20, 21, 22, 23, 24. The length increments between the rotational vanes 13, 14, 15, 16, 17, 18, 19, 20, 21, 22, 23, 24 is 1".

Figure 3:
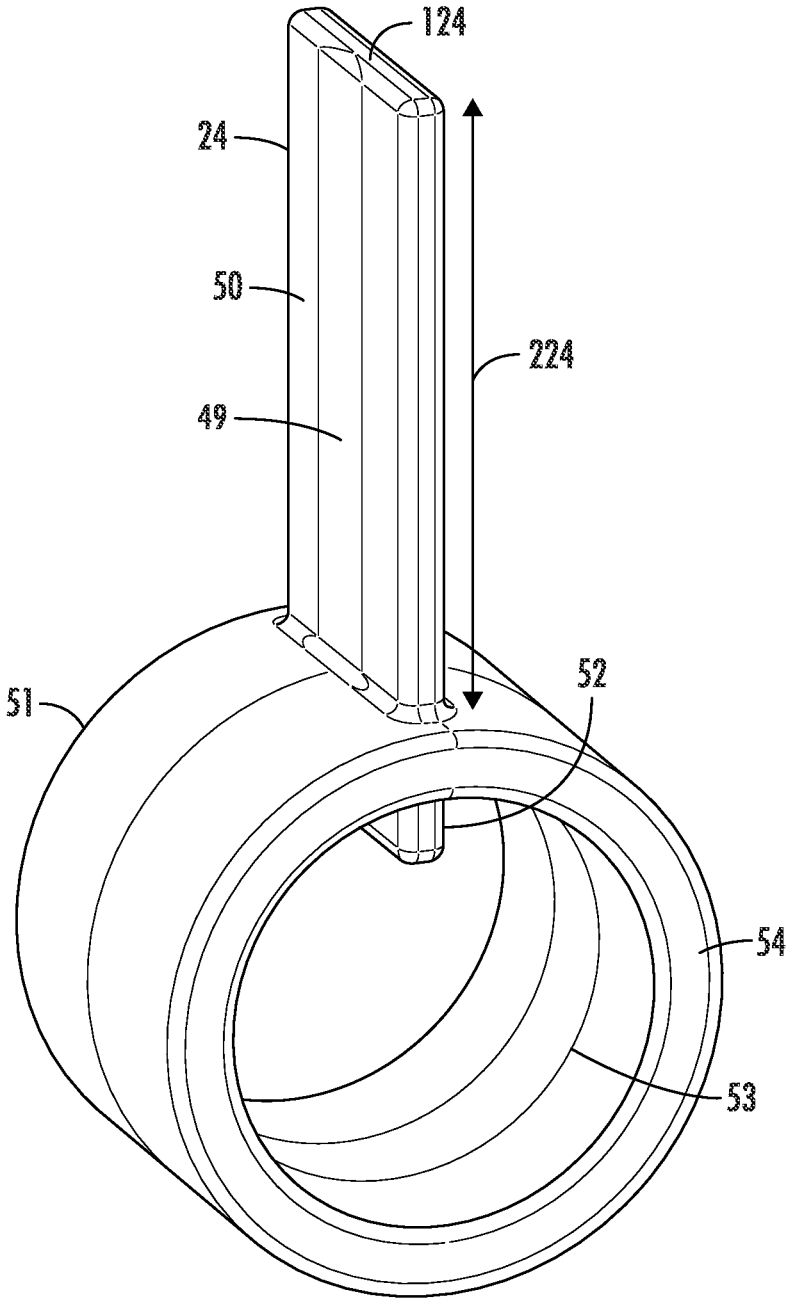
FIG. 3 is a perspective view of a single vane sub-assembly.

The rotational vane 24 with the shortest length 224 is shown in isolation in FIG. 3. The rotational vane 24 has a longitudinal member 50, a rim 54, a stop member 52, and a cylindrical element 51, 53. The cylindrical element 51, 53 has an exterior with a cylindrical outer surface 51 and an interior with a cylindrical inner surface 53. The longitudinal member has a planar surface 49 and a length 224. The length 224 of the longitudinal member 50 is measured from the tip 124 of the rotational vane 24 to the outer cylindrical surface 51.

Figure 2:
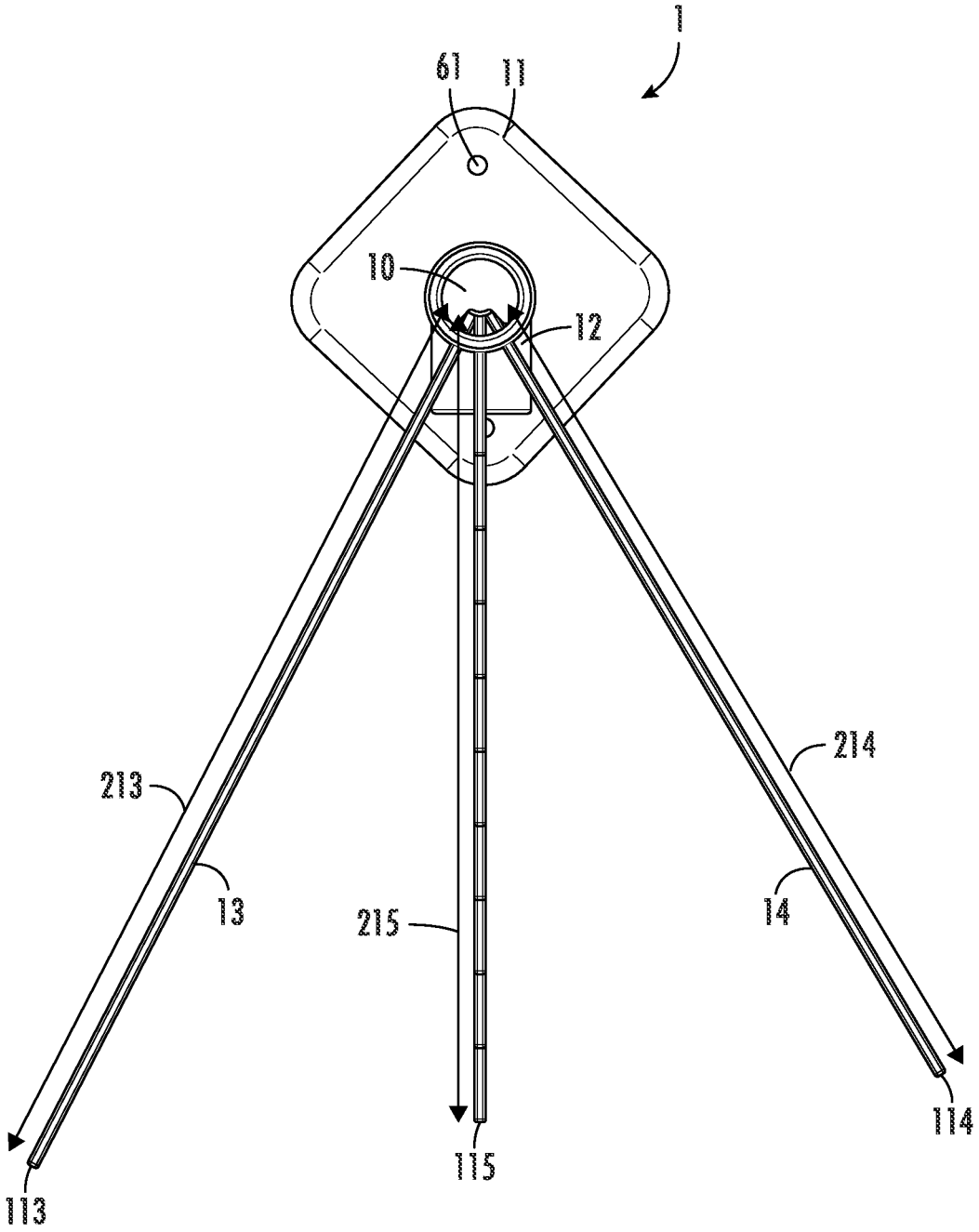
FIG. 2 is an end view of the invention.

Referring to FIGS. 1-3, the rotational vane 13 with the longest length 213 is 13" long from its cylindrical outer surface 151 to its 113 tip. The length 214 of the next longest rotational vane 14 is 12" from its tip 114 to its cylindrical outer surface 152. The length 215 of the next longest rotational vane 15 is 11" from its tip 115 to its cylindrical outer surface 153. This continues until the rotational vane 24 with the shortest length 224 has a length of 2" in this embodiment. This means that in use condition, the present invention 1 needs to be mounted so that the height of the user's standing vertical jump falls between the rotational vane 13 with the longest length 213 and the rotational vane 24 with the shortest length 224.

The number of rotational vanes 13, 14, 15, 16, 17, 18, 19, 20, 21, 22, 23, 24 can be increased from 12 to 24 or more by merely extending the length of the notched pole 10. Likewise, the length increment between adjoining rotational vanes 13, 14, 15, 16, 17, 18, 19, 20, 21, 22, 23, 24 can be decreased from 1" to ½ or even 1 cm. The length increment can also be increased to 2", where a wider range is desired.

Figure 4A:
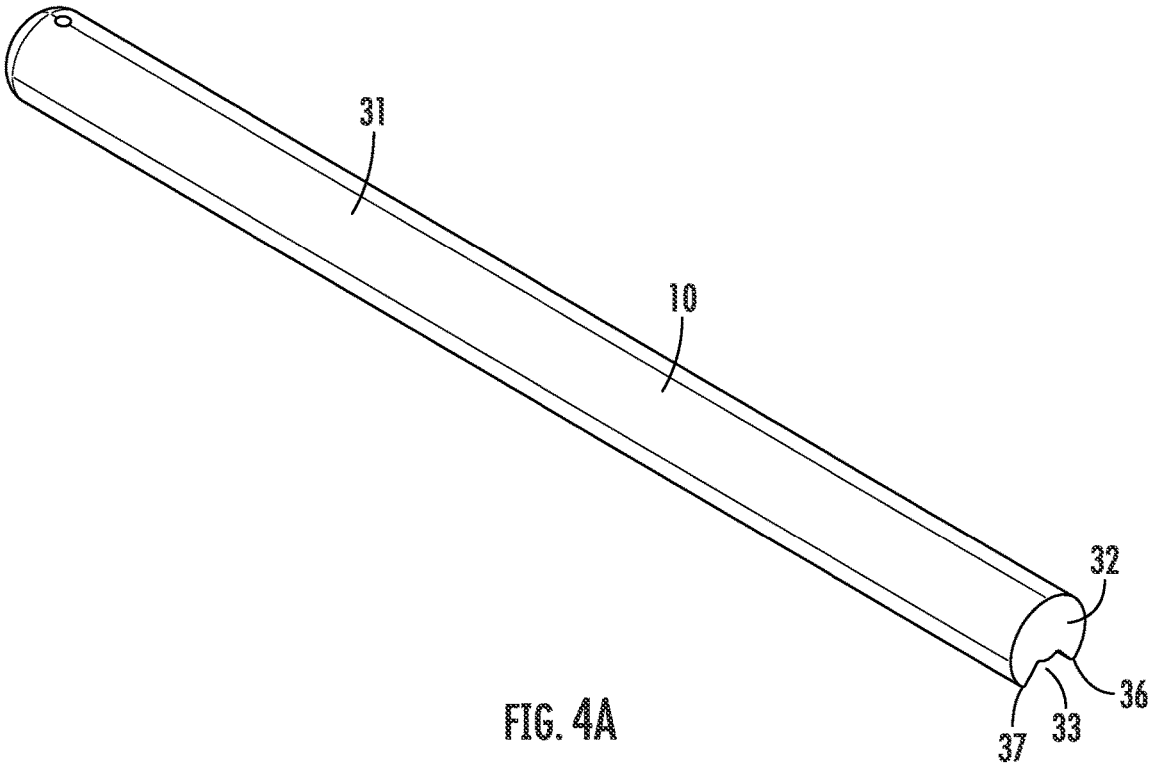
FIG. 4A is a perspective view of the post of the present invention.
Figure 4B:
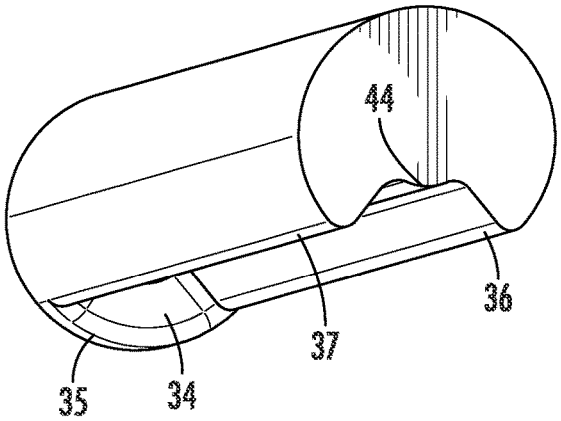
FIG. 4B is an alternative perspective view of the post of the present invention.
Figure 4C:
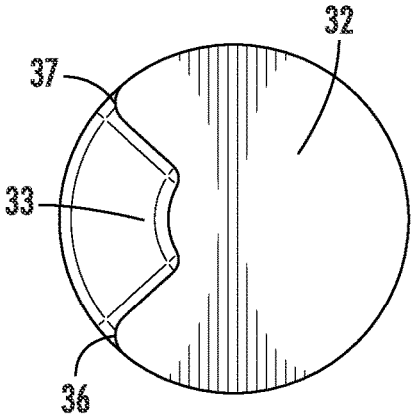
FIG. 4C is the end view of the post of the present invention.

FIGS. 4-5 show the notched pole 10 and its various aspects. FIG. 4A shows a top perspective view of the notched pole 10. The notched pole 10 has an outer surface 31 which is a cylindrical segment 31 and an end 32. The cylindrical segment 31 is cut at two edges 36, 37 creating a channel. In FIG. 4B and 4C show that the channel 33 terminates at the wall-end 34. The wall-end 34 has a circular radius 35. In the center 44 of the channel 33 is a bump 44.

Figure 5A:
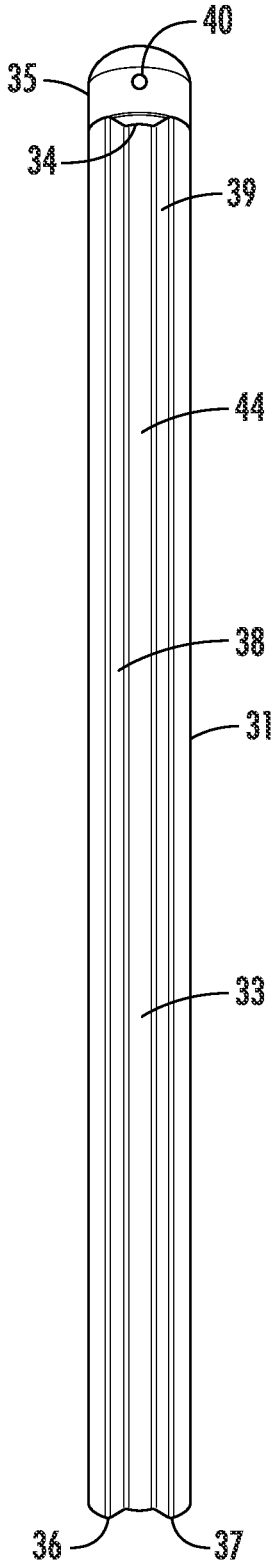
FIG. 5A is a bottom view of the post of the present invention.
Figure 5B:
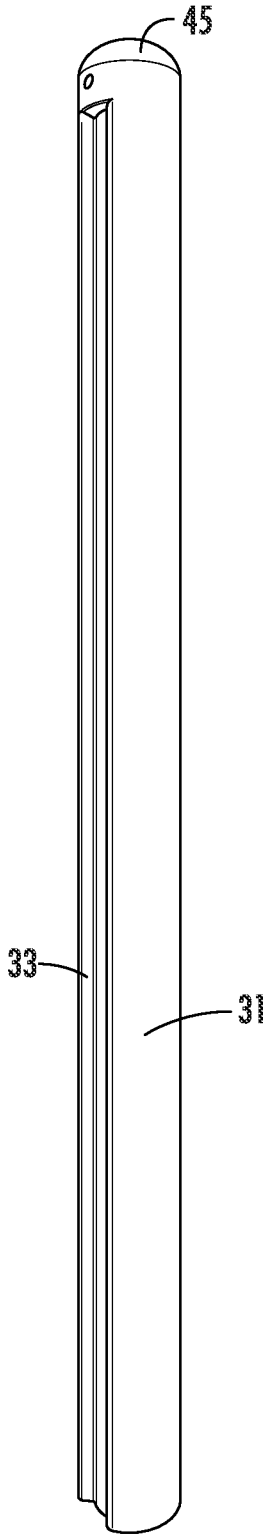
FIG. 5B is an side view of the post of the present invention.

FIG. 5A and 5B show the channel 33 in more detail. The edges 36, 37 cut the cylindrical segment 31, marking the boundary 36, 37 of the channel 33. The channel 33 has two sloping sides 38, 39, which terminate at the central bump 44 of the channel 33. The wall-end 34 has a circular radius 35. A hole 40 allows a set screw to affix the notched post 10 to the T-tube 12.

The rotational vane 24 is placed on the notched post 10 by aligning the stop member 52 with the channel 33 and inserting the notched post 10 through the cylindrical element 51, 53 of the rotational vane 24.

Figure 6A:
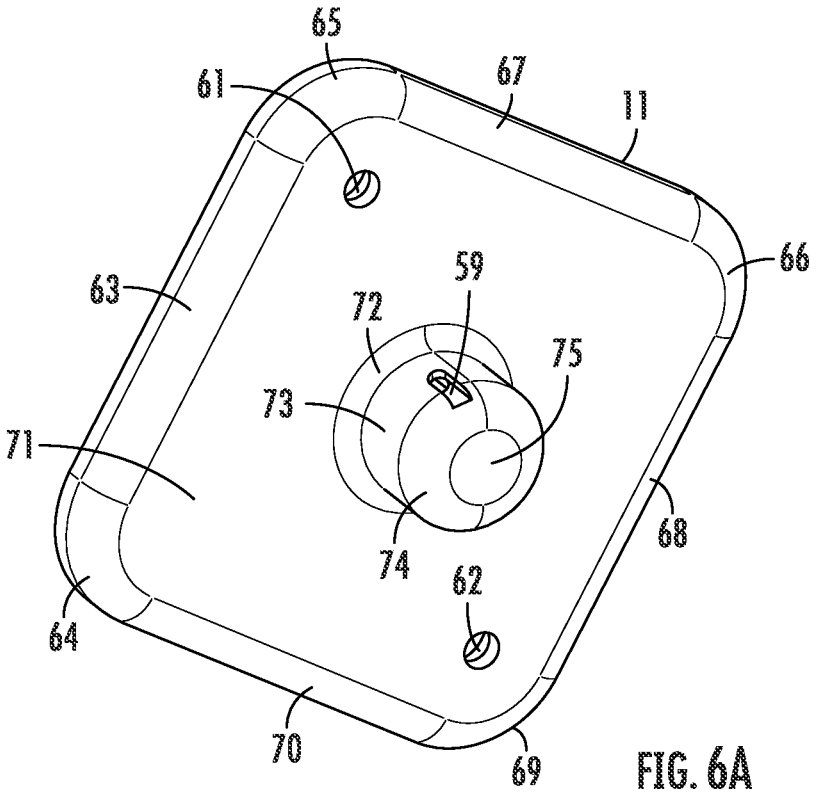
FIG. 6A is a front perspective view of the mount of the present invention.
Figure 6B:
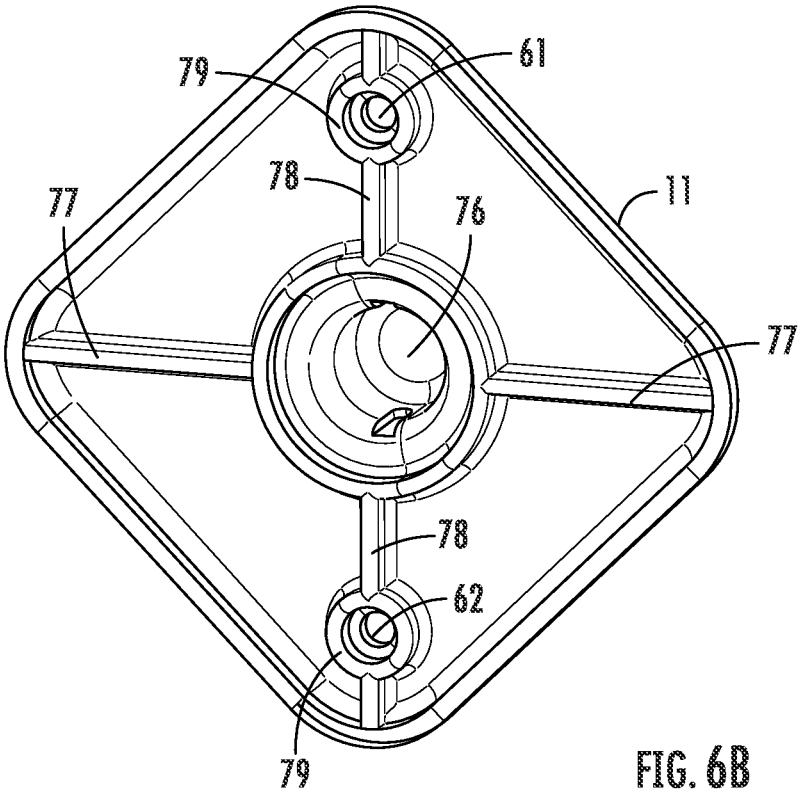
FIG. 6B is a rear perspective view of the mount of the present invention.
Figure 7:
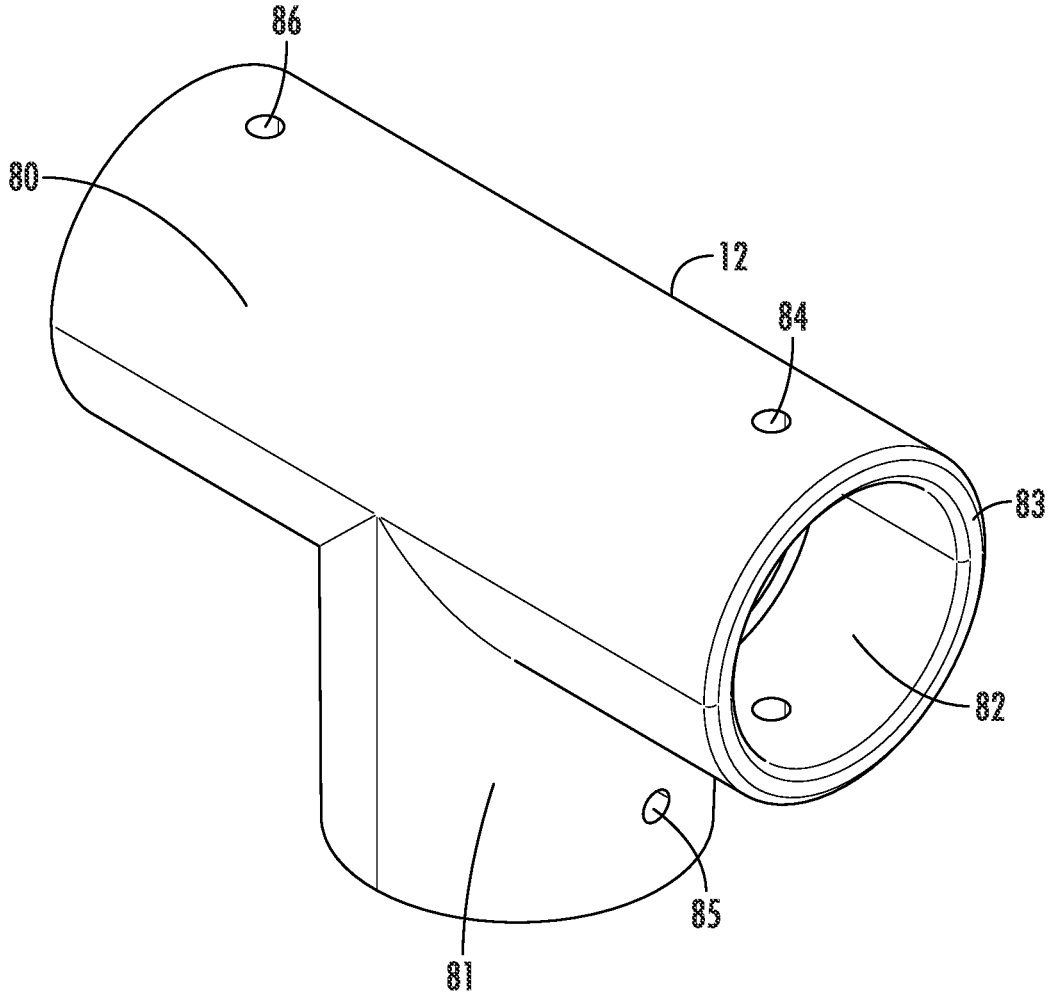
FIG. 7 is a perspective view of a T-tube, which allows the present invention to be wall or ceiling mounted.

The present invention FIG. 6A and 6B show the mount 11; FIG. 7 shows the T-tube 12. The T-tube 12 has three holes 86, 84, 85 which can accept set screws in order to affix both the notched post 10 and the mount 11. The inside 82 of the T-tube 12 is sized such that it accepts the wall-end 35 of the notched pole 10 and the protrusion 73 of the mount 11. The T-tube 12 has three ends 80, 83, 81, a first end 80, a second end 83, and a third end 81. The first end 80 and the second end 83 are parallel with one another 80, 83. The first end 80 and the second end 83 are both perpendicular to the third end 81.

FIG. 1 shows the mount 11 affixed to a first end 80 of the T-tube 12, with the notched pole 10 being affixed to a second end 83 that is parallel to the first end 80. In a first alternative configuration, the mount 11 affixed to the second end 83 of the T-tube 12, with the notched pole 10 being affixed to the first end 83. Both configurations are suitable when the mount 11 is affixed to a wall.

There are several configurations that could be used if the mount 11 is affixed to a ceiling. The mount 11 can be affixed to either the first end 80 or the second end 83, while the notched pole 10 is be affixed to the third end 81. Similarly, the mount 11 can be affixed to the third end 81 of the T-tube 12, while the notched pole 10 is secured to either the first end 80 or the second end 83.

FIGS. 6A and 6B show the mount 11 in detail. The mount 11 has two holes 61, 62 to affix the mount 11 to the wall, ceiling, or other suitable structure. The mount 11 has a protrusion 73, a planar surface 71, and a rounded edge 64, 63, 65, 67, 66, 68, 69, 70. There is a fillet 72 between the planar surface 71 and the protrusion 73. The protrusion 73 has a tip 75. There is a fillet 74 between the protrusion 73 and the tip 75. The protrusion 73 has a notch 59. The protrusion 73 is sized to fit within 82 the T-tube 12. When the protrusion 73 is inserted into the T-tube 12, it is secured with a set screw that goes through one of the holes 86, 84, 85 in the T-tube 12 and secures itself to the notch 59 in the protrusion 73.

FIG. 6B shows the rear of the mount 11. The protrusion 73 has a hollow inside 76 in order to reduce weight and material. The mount 11 has reinforcing ribs 77, 78 to add rigidity. The holes 61, 62, of the mount 11 have reinforcing bosses 79 to add strength to the mount.

In use, the plurality of vanes 13, 14, 15, 16, 17, 18, 19, 20, 21, 22, 23, 24 fit over the notched pole 10. The plurality of rotational vanes 13, 14, 15, 16, 17, 18, 19, 20, 21, 22, 23, 24 hang vertically from the notched pole 10. Each of the plurality of vanes 13, 14, 15, 16, 17, 18, 19, 20, 21, 22, 23, 24 has a stop member 52. For example, when a force is applied to the planar surface 49 of the longitudinal member 50 of a rotational vane 24, the rotational vane 24 will swing until the stop member 52 hits one of the two sloping sides 38, 39, of the channel 33. The stop member 52 will have an elastic collision with one of the two sloping sides 38, 39 of the channel, causing the rotational vane 24 to reverse direction. The center bump 44 in the channel 33 will interfere with the stop member 52 as it swings past, quickly bringing the rotational vane 24 to rest. Any of the plurality of rotational vanes 13, 14, 15, 16, 17, 18, 19, 20, 21, 22, 23, 24 may be set in motion in similar fashion.

The present invention 1 is designed so that the rotational vanes 13, 14, 15, 16, 17, 18, 19, 20, 21, 22, 23, 24 settle quickly enough so that a user can repeatedly and predictably jump and hit them, by swatting them, knowing which rotational vane 13, 14, 15, 16, 17, 18, 19, 20, 21, 22, 23, 24 was hit or swatted on each jump. This invention 1 allows a user to perform standing vertical jump sets. For example, consider a user with a very good maximum standing vertical jump of 40". If the present invention 1 is mounted so that the shortest length 224 rotational vane 24 requires the user to perform a standing vertical jump of at least 40" in order to hit it, the user would perform a set of 8-15 standing vertical jumps and would aim for an intermediate value such as a standing vertical jump of 34", represented, for example, by an intermediate rotational vane 18.

The user could perform multiple sets of such jumps, selecting the same intermediate value for each set.

Alternately, the user could perform multiple sets of standing vertical jumps, selecting a different intermediate value for each set. For example, the user could select an intermediate rotational vane 20 corresponding to 36", in the above example, for the first set. The user could select a second intermediate rotational vane 18 corresponding to 34" for the second set. The user could select a third intermediate rotational vane 16 corresponding to 32" for the third set.

I claim:

1. A jump training apparatus comprising:

a notched post having a first end, a second end, and an outer surface comprised of a cylindrical segment and a channel;

a mounting means for securely holding the notched post in a horizontal orientation;

a plurality of rotational vanes each having a tip, a longitudinal member, a stop member, and a cylindrical element;

wherein the cylindrical element of each of the rotational vanes has an exterior with a cylindrical outer surface and an interior with a cylindrical inner surface;

wherein the stop member of each of the rotational vanes is attached to, and projects away from, the interior cylindrical surface of the rotational vane; and wherein the plurality of rotational vanes are placed on the notched post by aligning the stop member with the channel and inserting the notched post through the cylindrical element of the rotational vane.

2. The jump trainer apparatus of claim 1, wherein the mounting means is comprised of a mount that secures the notched post to a structure.

3. The jump trainer apparatus of claim 2, wherein the plurality of rotational vanes hang vertically from the notched post.

4. The jump trainer apparatus of claim 3, wherein the longitudinal member of each of the plurality of rotational vanes has a planar surface.

5. The jump trainer apparatus of claim 4, wherein the channel has a first sloped side, a second sloped side, and a central bump.

6. The jump trainer apparatus of claim 5, wherein the notched post is a complete cylinder with the exception of the channel.

7. The jump trainer apparatus of claim 5, wherein the longitudinal member of each of the plurality of rotational vanes has a length, measured from a tip of the rotational vane to the cylindrical outer surface.

8. The jump trainer apparatus of claim 7, wherein the plurality of rotational vanes are arranged on the notched post in descending order, based on the length of the longitudinal member of the rotational vane.

9. The jump trainer apparatus of claim 7, wherein the plurality of rotational vanes are arranged on the notched post in ascending order, based on the length of the longitudinal member of the rotational vane.

10. The jump trainer apparatus of claim 7, wherein, when a rotational vane is disturbed from its rest position by a force applied to the planar surface of its longitudinal member, the rotational vane will rotate until the stop member hits at least one of the first sloped side of the channel or the second sloped side of the channel, at which point the rotational vane will reverse direction.

11. The jump trainer apparatus of claim 10, wherein contact between the stop member and the central bump of the channel will cause the rotational vane to come to rest.

12. The jump trainer apparatus of claim 11, wherein the stop member is parallel with the longitudinal member.

13. The jump trainer apparatus of claim 12, wherein the plurality of rotational vanes is twelve.

14. The jump trainer apparatus of claim 2, wherein the mounting means is further comprised of a T-tube having a first opening, a second opening, and a third opening, which is interposed between the mount and the notched post, wherein the T-tube allows the notched post to remain in a horizontal position.

15. A method of physical training using a jump training apparatus comprising the steps of mounting a jump training apparatus having a mount, a plurality of vertically hanging rotational vanes of varying lengths, and a notched post with a channel, wherein the notched post is attached to the mount and the plurality of vertically hanging rotational vanes are placed on the notched post;

arranging the plurality of vertically hanging rotational vanes in order of their length;

determining the maximum standing vertical jump by jumping and striking the vertically hanging rotational vane with the shortest length that is reachable;

adjusting the jump training apparatus so that the vertically hanging rotational vane with the shortest length overall corresponds to the maximum standing vertical jump; and performing a set of jumping exercises by jumping repeatedly and striking one or more of the plurality of vertically hanging rotational vanes.

16. The method of physical training using a jump training apparatus in claim 15, comprising the further steps of performing a second set of jumping exercises by jumping repeatedly and striking one or more of the plurality of vertically hanging rotational vanes.

17. The method of physical training using a jump training apparatus in claim 16, comprising the further step of performing a third set of jumping exercises by jumping repeatedly and striking one or more of the plurality of vertically hanging rotational vanes.

18. The method of physical training using a jump training apparatus in claim 17, wherein each set of jumping exercises is comprised of at least ten jumps.

19. The method of physical training using a jump training apparatus in claim 15, comprising the further step of assigning a specific vertically hanging rotational vane to be struck on each jump of the set.

20. The method of physical training using a jump training apparatus in claim 19, wherein the set of jumping exercises is performed until the assigned specific vertically hanging rotational vane is no longer reachable when jumping.

21. The method of physical training using a jump training apparatus in claim 15, wherein each of the plurality of vertically hanging rotational vanes quickly ceases to rotate after being struck, because of a stop member attached to, and integral with, the vertically hanging rotational vane contacts a sloping side of the channel, causing the vertically hanging rotational vane to reverse its direction of rotation.

22. The method of physical training using a jump training apparatus of claim 21, wherein the stop member contacts a bump in the center of the channel, further reducing the vertically hanging rotational vane's rotation.

23. The method of physical training using a jump training apparatus of claim 22, wherein the vertically hanging rotational vanes are arranged in descending order, starting at the side of the notched post closest to the mount.

24. The method of physical training using a jump training apparatus of claim 21, wherein the vertically hanging rotational vanes are arranged in ascending order, starting at the side of the notched post closest to the mount.

* * * * *